US005655976A

United States Patent [19]

Rife

[11] Patent Number: 5,655,976

[45] Date of Patent: Aug. 12, 1997

[54] GOLF CLUB HEAD WITH IMPROVED WEIGHT CONFIGURATION

[76] Inventor: Guerin Rife, 331 Park Ave. South B, Winter Park, Fla. 32789

[21] Appl. No.: 574,295

[22] Filed: Dec. 18, 1995

[51] Int. Cl.[6] ..... A63B 53/04

[52] U.S. Cl. ..... 473/340; 473/335; 473/336; 473/349

[58] Field of Search ..... 473/291, 334, 473/335, 336, 337, 338, 339, 340, 341, 342, 344, 345, 346

[56] References Cited

U.S. PATENT DOCUMENTS

| | | | |
|---|---|---|---|
| 3,680,868 | 8/1972 | Jacob | 473/336 |
| 4,502,687 | 3/1985 | Kochevar | 473/345 |
| 4,630,825 | 12/1986 | Schmidt et al. | 473/338 |
| 4,695,054 | 9/1987 | Tunstall | 473/338 |
| 4,708,347 | 11/1987 | Kobayashi | 473/338 |
| 4,828,266 | 5/1989 | Tunstall | 473/336 |
| 5,062,639 | 11/1991 | Hitt | 473/335 |
| 5,489,097 | 2/1996 | Simmons | 473/337 |
| 5,494,288 | 2/1996 | Jimenez et al. | 473/341 |

*Primary Examiner*—William M. Pierce
*Attorney, Agent, or Firm*—Aquilino & Welsh

[57] ABSTRACT

A golf club head having an elongated weight formed adjacent the leading edge and located in a heel to toe direction.

8 Claims, 4 Drawing Sheets

FIG. 5
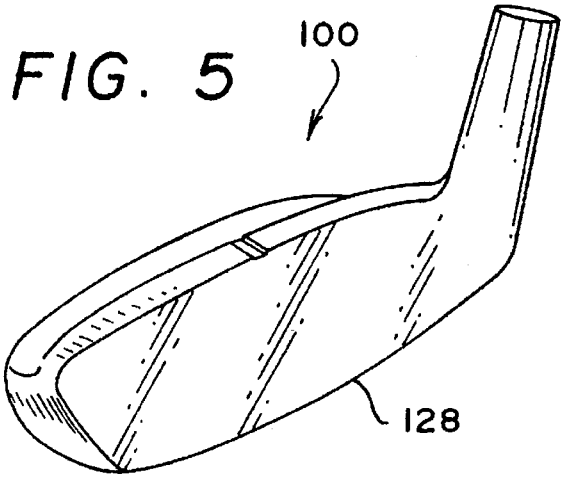
FIG. 7
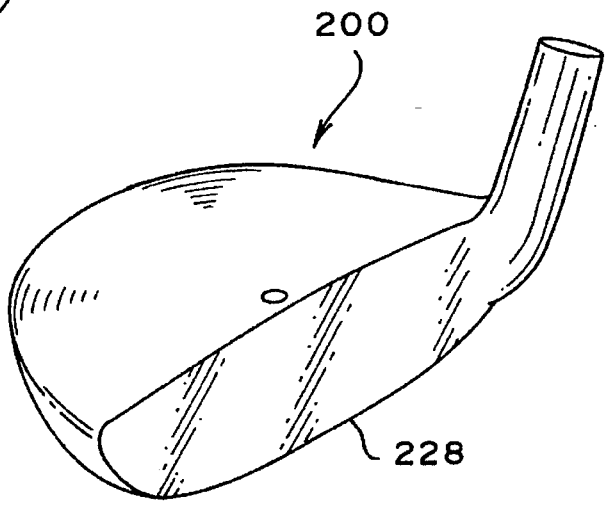
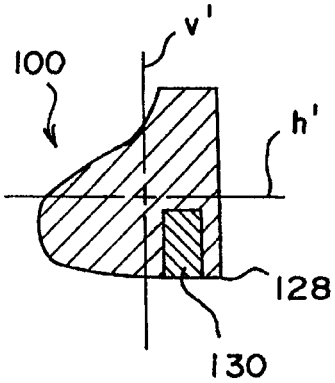
FIG. 6
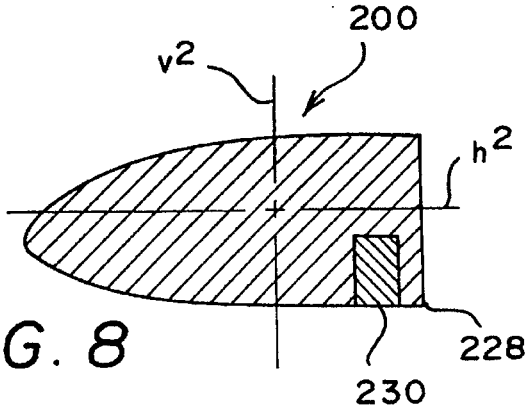
FIG. 8
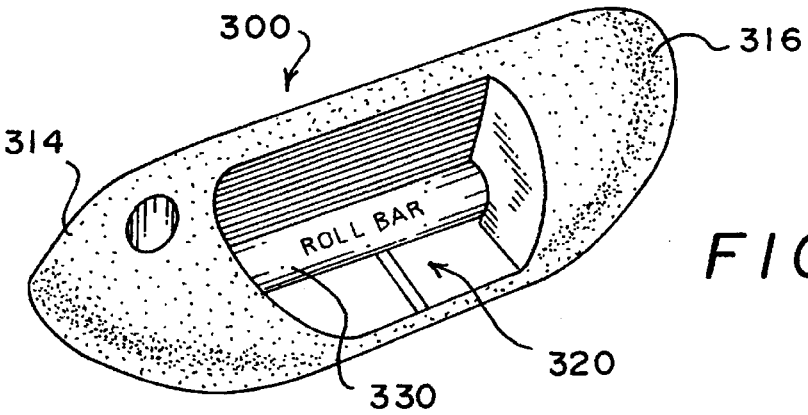
FIG. 9

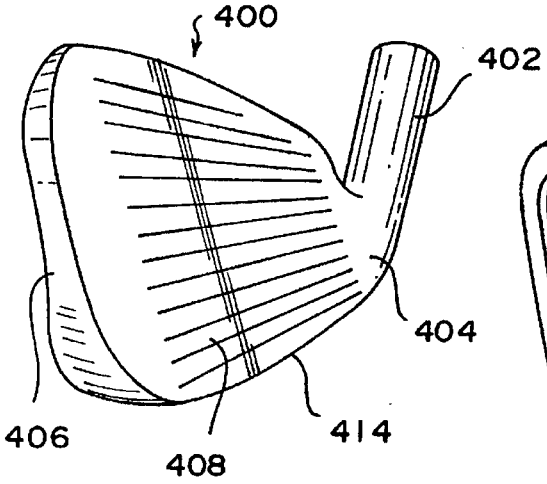
FIG. 10
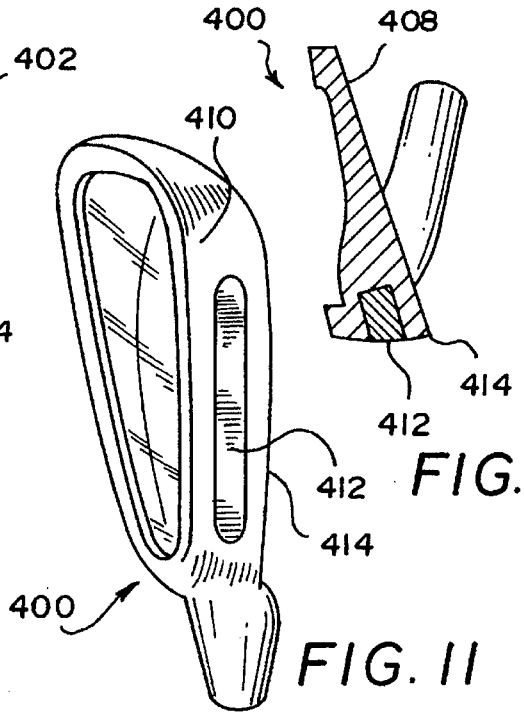
FIG. 11
FIG. 12
FIG. 13
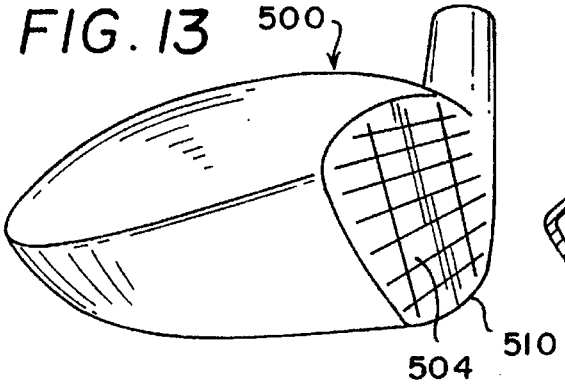
FIG. 14
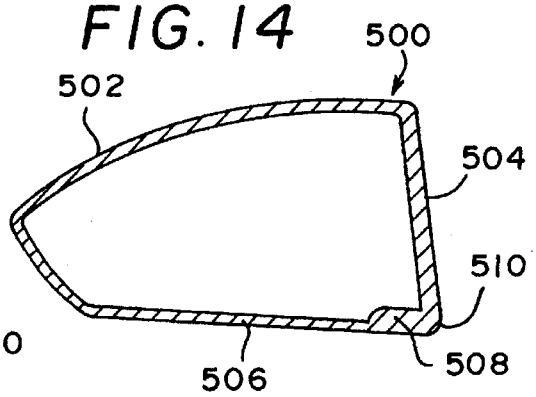
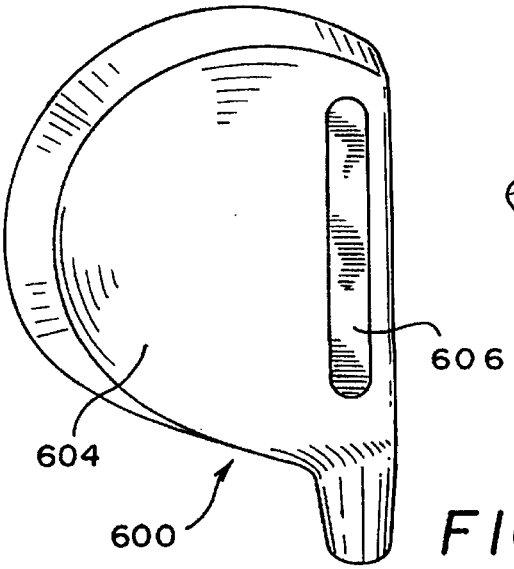
FIG. 15
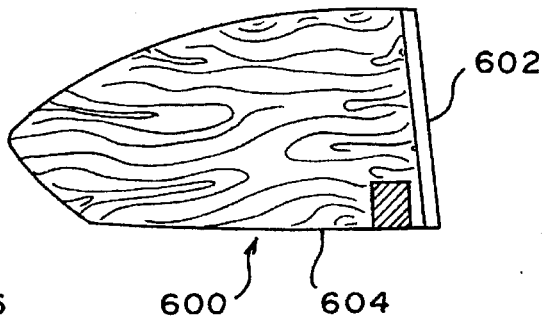
FIG. 16

GOLF CLUB HEAD WITH IMPROVED WEIGHT CONFIGURATION

BACKGROUND AND SUMMARY OF THE INVENTION

The present invention is directed to improving a golf club and in particular a golf club having an improved weight configuration.

It is well known in the golf club art to provide golf club heads with a variety of weight configurations to offset the center of mass of the club head, thereby providing weighting characteristics to control the flight and/or direction of a golf ball struck by the weighted club head. A common club head weighting structure provides weight at the heel and toe portions of the club head to minimize torque and twisting of the club when the ball is struck off of the precise center of percussion. Other golf club heads, including those with adjustable weights, are available.

The present invention relates to a golf club head with significant bottom weighting, which lowers the center of gravity of the club head. The bottom weighting helps the club head to travel closer to the ground, and causes a lifting effect when the ball is struck, thereby creating overspin aiding the ball to maintain a truer path toward the target. The club head is provided with an elongated weight member which is located adjacent the leading edge of the club head along the bottom and just behind the lower part of the ball striking face. The elongated weight member extends in a longitudinal direction between the heel and toe of the club head. Preferably, the weight is made of a more dense metal, such as lead, tungsten or similar material. The weight may be shaped as an elongated cylinder or rectangle and may be designed to fit within an opening or slot molded directly into the club head.

The present invention finds particular application for a putter type golf club head. The bottom weighting helps the putter to travel lower to the ground and produces a lifting effect, which creates an overspin or forward tracking effect on the ball as it rolls along the ground surface. The weigh configuration is particularly applicable to a heel-toe weighted putter, however, it will be appreciated that the elongated bottom weight may be used with any type of putter design, including blade and mallet putter head types.

Among the objects of the present invention, is the provision of a golf club head having an improved weight configuration which lowers the center of gravity of the club head.

Another object of the present invention is the provision of a putter type golf club head, having a weight insert, which provides a lifting effect to the ball when it is struck.

Other objects and advantages of the present invention will become apparent from the following detailed description when viewed in conjunction with the accompanying drawings, which set forth certain embodiments of the invention.

DESCRIPTION OF THE DRAWINGS

FIG. 5 is a front perspective view of a second embodiment of a putter type golf club head in accordance with the present invention.

FIG. 6 is a sectional view taken along the lines 6—6 of FIG. 5.

FIG. 7 is a front perspective view of a third embodiment of a putter type golf club head in accordance with the present invention.

FIG. 8 is a sectional view taken along the lines 8—8 of FIG. 7.

FIG. 9 is a rear perspective view of a fourth embodiment of a putter type golf club head in accordance with the present invention.

FIG. 10 is a front perspective view of an iron type golf club head in accordance with the present invention.

FIG. 11 is a bottom view of the iron type golf club head of FIG. 10.

FIG. 12 is an end sectional view taken along the lines 12—12 of FIG. 10.

FIG. 13 is a perspective view of a metal wood type golf club head in accordance with the present invention.

FIG. 14 is a sectional view taken along the lines 14—14 of FIG. 13.

FIG. 15 is a bottom view of a wood type golf club head in accordance with the present invention.

FIG. 16 is a sectional view taken along the lines 16—16 of FIG. 15.

DESCRIPTION OF THE PREFERRED EMBODIMENT

Figure 1:
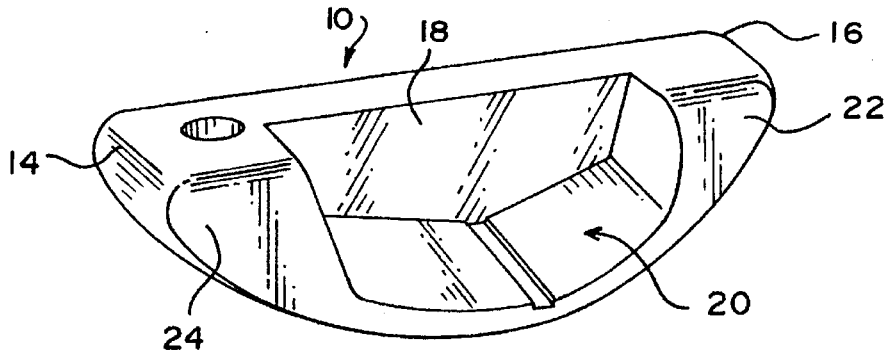
FIG. 1 is a rear perspective view of a putter type golf club head in accordance with the present invention.
Figure 2:
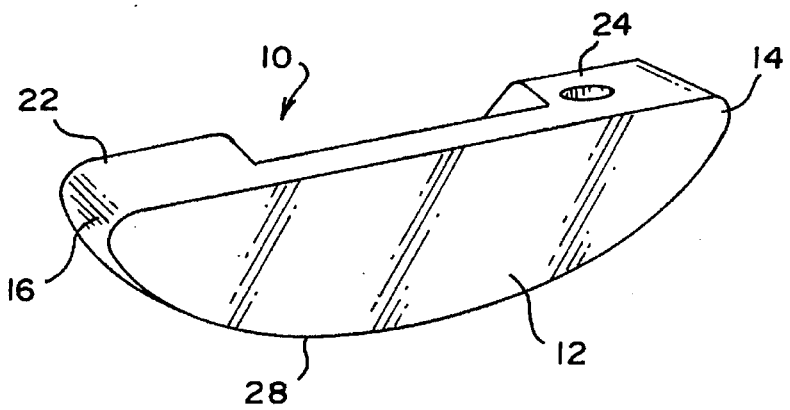
FIG. 2 is a front perspective view of the club head of FIG. 1.
Figure 3:
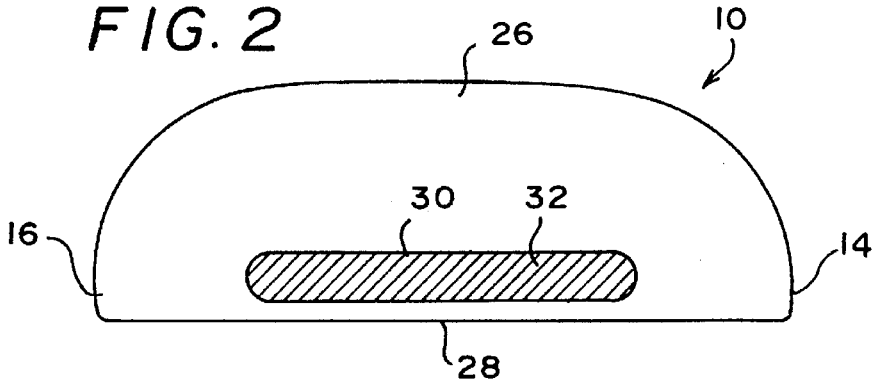
FIG. 3 is a bottom view thereof.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, FIGS. 1–4 show a first embodiment of a putter type golf club head 10 of the present invention, including a ball striking face 12, a heel 14, a toe 16, a rear surface 18, a rear cavity 20, defined by a rear peripheral toe weight 22 and a heel weight 24, and a bottom surface 26. A leading edge 28 of club head 10 is defined by the intersection of the ball striking space 12 and the bottom surface 26. An elongated bottom weight 30 is located within the club head adjacent the leading edge and has a longitudinal axis extending between the heel 14 and the toe 16. In this embodiment, the bottom weight 30 is a generally rectangular shaped member having an outer surface 32 which is flush with the bottom surface 26 of club head 10. Preferably, the club head 10 would be cast or otherwise formed with an elongated slot (not shown) sized to receive the elongated bottom weight 30. Alternately the club head may be formed in a mold in which a heavier elongated bottom weight had been previously placed.

It will be appreciated that the bottom weight 30 is made of a heavy, dense metal having a greater mass per unit of volume than the material used to form the remainder of the club head 10. Typically, metals such as lead, tungsten or depleted uranium, known as "heavy metal", are well suited for this purpose. The size and total weight of the bottom weight 30 may be adjusted to provide putter heads of varying weights and other characteristics.

Figure 4:
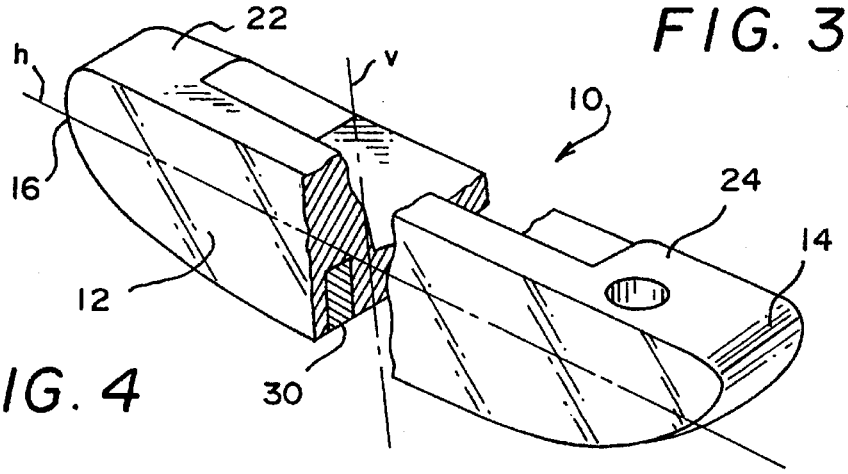
FIG. 4 is an exploded front sectional view of the club head of the present invention.

Referring to FIG. 4, the bottom weight 30 is located in a bottom forward quadrant of the club head 10 when viewed in section; the bottom forward quadrant being defined by a horizontal midline h between the leading edge 28 and a top edge 34 of the ball striking face 12 and a vertical midline v between the ball striking face 12 and the rear surface 18. The location of the bottom weight 30 in the lower forward quadrant of the club head 10 creates lift when a golf ball is struck thereby eliminating the need for a high degree of loft on the ball striking face.

FIGS. 5 and 6 show a second embodiment of a blade type putter golf club head 100 in accordance with the present invention. This club head 100 differs from the club head described hereinabove by the absence of a rear cavity. An elongated bottom weight 130 is positioned within the club head 100 adjacent the leading edge 128 in a lower forward quadrant defined by a horizontal midline h1 and a vertical midline v1.

FIGS. 7 and 8 show a third embodiment of a mallet type golf club head 200. As with the previous embodiments an elongated bottom weight 230 is positioned within the club head 200 adjacent the leading edge 228 in a lower forward quadrant defined by a horizontal midline h2 and a vertical midline v2.

FIG. 9 illustrates a fourth embodiment of a putter type golf club head 300 having a rear cavity 320 ad an elongated weight 330 which extends upwardly into the rear cavity and which is located in a heel 314 to toe 316 direction.

FIG. 10 shows an iron type golf club head 400 including a hosel 402, a heel 404, toe 406 and ball striking face 408. The club head 400 includes a bottom surface 410 and an elongated bottom weight 412 formed in the bottom surface 410. The bottom weight 412 is positioned slightly behind a leading edge 414 of the club head 400 formed by the intersection of the ball striking face 408 and the bottom surface 410.

FIGS. 13 and 14 show a metal wood type golf club head 500 made of a thin metal shell 502 as seen in the sectional view of FIG. 14. The club head 500 includes a ball striking face 504 and bottom surface 506. An elongated weight member 508 is formed intregally within the club head shell 502 adjacent the leading edge 510 formed by the intersection of the ball striking face 504 and bottom surface 506. It will be appreciated that the elongated weight 508 is molded with the shell 502 and of the same metal.

FIGS. 15 and 16 show a wood type golf club head 600 including a ball striking face 602 and bottom surface 604. An elongated weight member 606 is preferably placed in a slot formed in the bottom surface 604 sized to receive the weight member 606.

Figure 17:
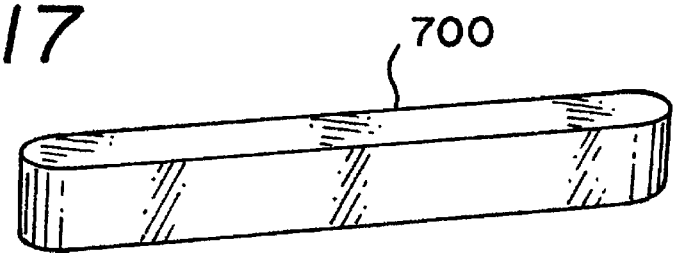
FIGS. 17, 18, 19, 20, and 21 show alternate embodiments of weight inserts used with the present invention.
Figure 18:
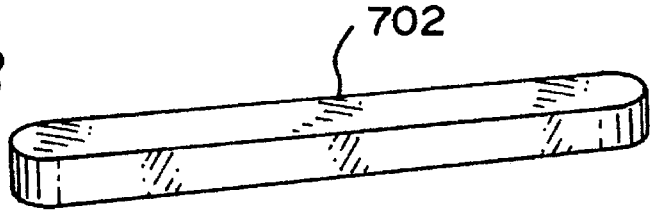
Figure 19:
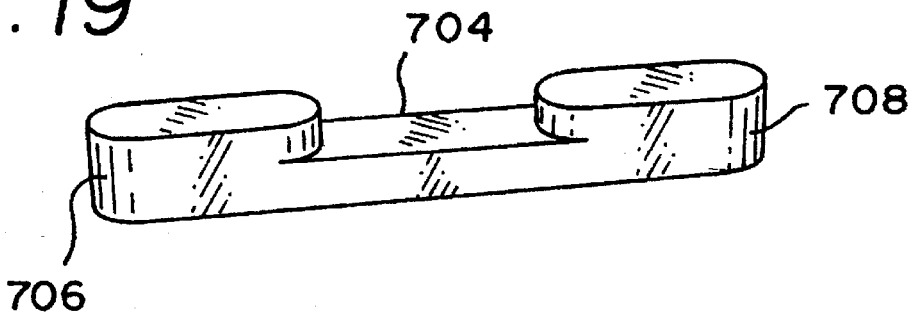
Figure 20:
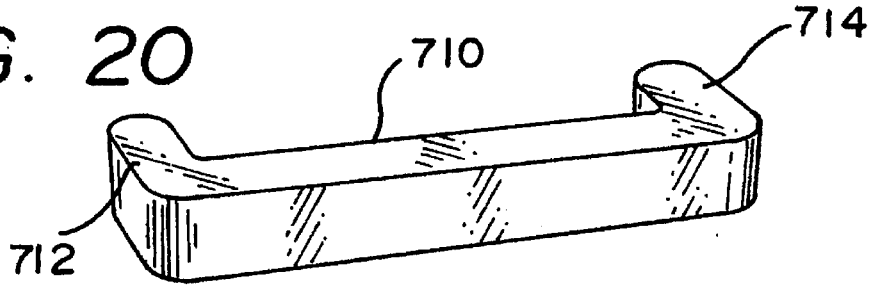
Figure 21:
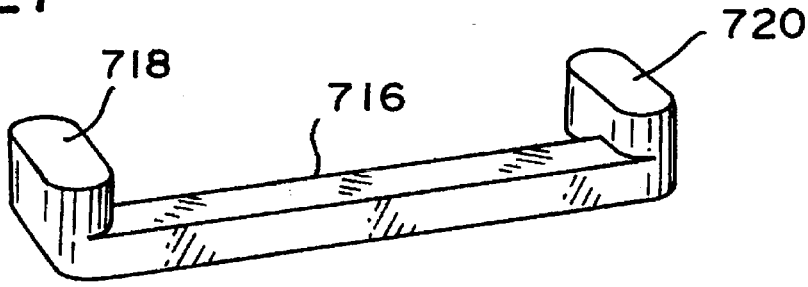

It will be appreciated that the size and relative length of the elongated weight member may be varied to provide a custom golf club suited to particular playing characteristics of a golfer. For example, referring to FIGS. 17–21, various embodiments of weight member inserts are shown. FIG. 17 shows an insert 700 which is elongated and generally rectangular in shape with rounded ends. FIG. 18 shows another insert 702 which is similar to insert 700 except it is thinner in elevation and weighs less. FIG. 19 shows an insert 704 which is also elongated and which includes end weights 706 and 708 to provide additional heel-toe weighting to a golf club within which the insert 704 is used. The end weights 706 and 708 extend upwardly from an upper surface of the insert 704. FIG. 20 shows another elongated insert 710 having additional weights 712 and 714 at the ends and which extend rearwardly from a rear surface on the insert 710. FIG. 21 shows still another insert 716 having additional weights 718 and 720 which extend both rearwardly and upwardly from ends of the insert 716.

It will also be appreciated the present invention is equally applicable to any size or shape of golf club head in addition to the embodiments described hereinabove. Other changes or modifications may be made in keeping within the scope and spirit of the present invention as defined by the following claims.

I claim:

1. A putter type golf club head including a toe, a heel, a bottom surface, a ball striking face having a top edge and a leading edge formed at the intersection of the ball striking face and the bottom surface, and a rear surface, wherein the improvement comprises:

an elongated weight member located totally within a lower forward quadrant of the club head, said forward quadrant defined by a horizonal midline between said top edge and said bottom surface and a vertical midline between said ball striking face and said rear surface; said elongated weight member being positioned adjacent the leading edge and extending longitudinally in a heel to toe direction, said elongated weight member including a surface flush with said bottom surface and being made of a material more dense and heavier than the material forming said club head.

2. The golf club head of claim 1, including a toe mass and a heel mass defining a rear cavity behind said ball striking face.

3. The golf club head of claim 2, wherein said elongated weight member is located between said toe mass and said heel mass within said cavity.

4. The golf club head of claim 1, wherein said club head includes a slot formed in said bottom surface for placement of said elongated weight member.

5. The golf club head of claim 1, wherein said elongated weight member is rectangular in shape.

6. The golf club of claim 5 wherein said weight member includes a secondary weight located at each end and extending upwardly from an upper surface of said weight member.

7. The golf club of claim 5 wherein said weight member includes a secondary weight located at each end and extending rearwardly from a rear surface of said weight member.

8. The golf club of claim 5 wherein said weight member includes a secondary weight located at each end and extending upwardly and rearwardly from said weight member.

* * * * *